US009157273B2

(12) United States Patent
Dekker et al.

(10) Patent No.: US 9,157,273 B2
(45) Date of Patent: Oct. 13, 2015

(54) CONICAL CORD-WINDING SPOOL WITH CIRCUMFERENTIAL STEPS

(75) Inventors: Nicolaas Dekker, PA Rhoon (NL); Christianus Wilfred Michael Slobbe, DS Tilburg (NL)

(73) Assignee: Hunter Douglas Industries BV, Rotterdam (NL)

( * ) Notice: Subject to any disclaimer, the term of this patent is extended or adjusted under 35 U.S.C. 154(b) by 0 days.

(21) Appl. No.: 13/641,475

(22) PCT Filed: Apr. 1, 2011

(86) PCT No.: PCT/EP2011/001656

§ 371 (c)(1), (2), (4) Date: Nov. 8, 2012

(87) PCT Pub. No.: WO2011/128028

PCT Pub. Date: Oct. 20, 2011

(65) Prior Publication Data

US 2013/0048235 A1 Feb. 28, 2013

(30) Foreign Application Priority Data

Apr. 16, 2010 (EP) ..... 10004038

(51) Int. Cl.
*E06B 9/262* (2006.01)
*E06B 9/322* (2006.01)

(52) U.S. Cl.
CPC ..... *E06B 9/322* (2013.01)

(58) Field of Classification Search
CPC ..... E06B 2009/3225; E06B 2009/3227; E06B 9/262; E06B 2009/2622; E06B 2009/2625
USPC ..... 160/170, 171, 168.1 R, 173 R; 242/613.1, 365.1, 407, 366.1, 366.2, 242/302.1, 374; 254/374
See application file for complete search history.

(56) References Cited

U.S. PATENT DOCUMENTS 2,930,539 A * 3/1960 Bremer ..... 242/470
3,212,727 A * 10/1965 Fonden et al. ..... 242/602.1

(Continued)

FOREIGN PATENT DOCUMENTS

DE 19505824 8/1996
EP 1431508 A2 6/2004

OTHER PUBLICATIONS

International Search Report; International Application No. PCT/EP2011/001656; International Filing Date: Apr. 1, 2011; 3 pages.

(Continued)

*Primary Examiner* — Blair M Johnson
(74) *Attorney, Agent, or Firm* — Blank Rome LLP

(57) ABSTRACT

A mechanism for extending or retracting for a covering for an architectural opening with respect to architectural opening, including a rotatable drive shaft (5); at least one lift cord (11,13), at least one cord spool (7,9) for winding and unwinding the at least one lift cord, the cord spool being mounted for rotation with the drive shaft and being axially stationary. The cord spool has a first diameter end (21, 27) and a second diameter end (23, 29), the first diameter being larger than the second diameter, and the spool has a first generally conical circumferential spool portion (33) therebetween, wherein the first spool portion (33) comprises a plurality of steps (35, 37, 39, 41, 43, 45) each step having a tread (35A, 37A, 39A, 41A, 43A, 45A).

10 Claims, 3 Drawing Sheets

(56) References Cited

U.S. PATENT DOCUMENTS

Figure 1:
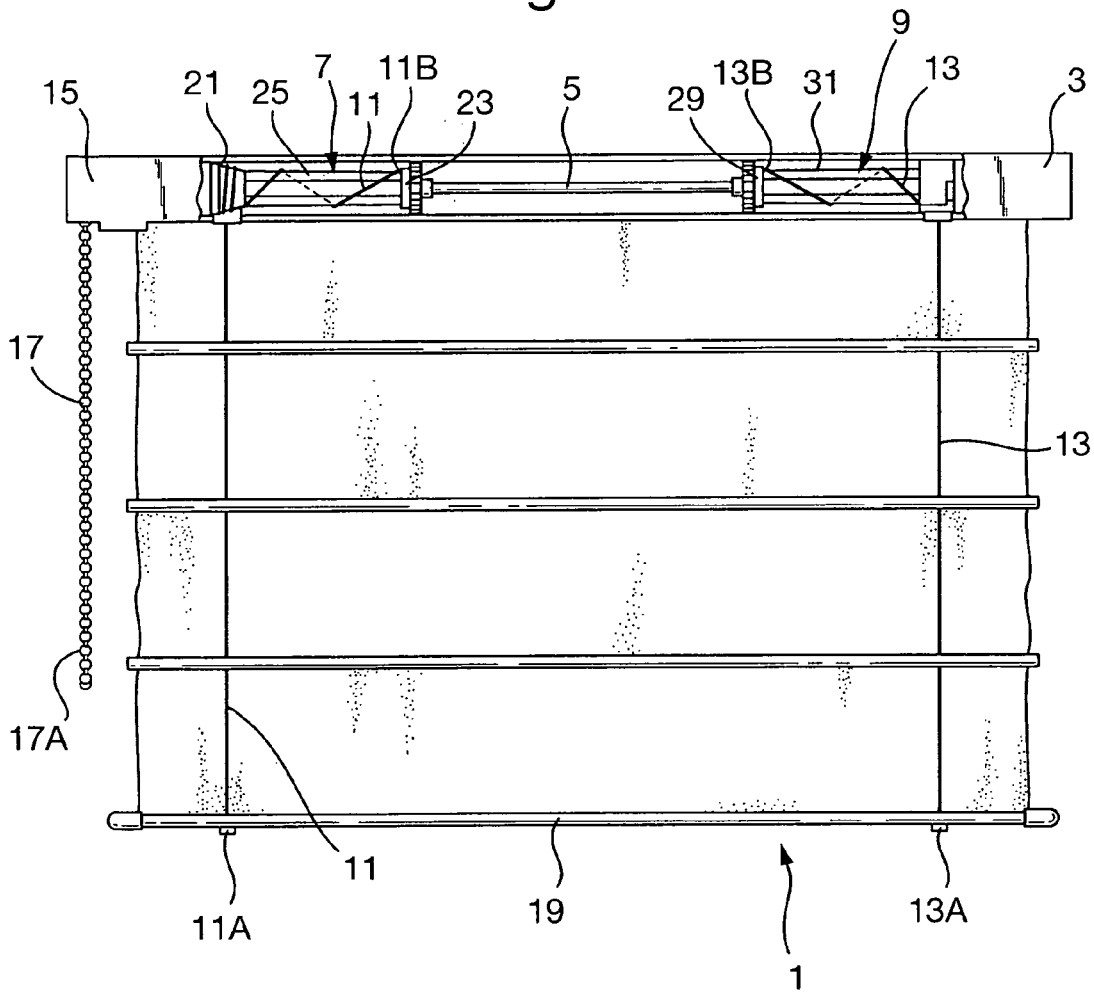

| | | | | |
|---|---|---|---|---|
| 3,339,860 | A * | 9/1967 | Riggles, Jr. | 242/602.2 |
| 5,328,113 | A * | 7/1994 | de Chevron Villette et al. | 242/388 |
| 5,725,040 | A * | 3/1998 | Domel | 160/170 |
| 5,908,062 | A * | 6/1999 | Fun | 160/170 |
| 6,622,769 | B2 * | 9/2003 | Judkins | 160/84.05 |
| 6,915,831 | B2 * | 7/2005 | Anderson | 160/173 R |
| 7,137,430 | B2 * | 11/2006 | Fraczek | 160/170 |
| 7,178,577 | B2 * | 2/2007 | Liu | 160/170 |
| 7,210,646 | B2 * | 5/2007 | Hsu | 242/397 |
| 7,311,133 | B2 * | 12/2007 | Anderson et al. | 160/170 |
| 7,464,742 | B2 * | 12/2008 | Oskam et al. | 160/170 |
| 7,654,300 | B2 * | 2/2010 | Chigusa | 160/170 |
| 7,686,059 | B2 * | 3/2010 | Jarosinski et al. | 160/84.03 |
| 2001/0035269 | A1 | 11/2001 | Judkins | |
| 2003/0178155 | A1 * | 9/2003 | Fraczek | 160/170 |
| 2004/0016517 | A1 * | 1/2004 | Anderson | 160/173 R |
| 2006/0000562 | A1 * | 1/2006 | Liu | 160/173 R |
| 2013/0048235 | A1 * | 2/2013 | Dekker et al. | 160/319 |
| 2013/0193251 | A1 * | 8/2013 | Barea | 242/365.1 |

OTHER PUBLICATIONS

English Abstract; German Patent Application No. DE19505824(1); 1 page.

* cited by examiner

CONICAL CORD-WINDING SPOOL WITH CIRCUMFERENTIAL STEPS

The present invention relates to a mechanism for extending or retracting a covering for an architectural opening, such as venetian blinds, roman shades, pleated window coverings or the like. It includes a drive shaft and a driven cord spool mounted in keyed connection with the drive shaft, about which a lift cord can be wound in order to retract or extend the window covering.

In the art conical spools are known that usually have a first end having a first diameter and a second end having a second diameter, the second diameter being smaller than the first. Such spools generally include a sloping portion where, the diameter of the spool reduces from the first diameter over a predetermined axial length to the second smaller diameter. Alternatively a relatively steep and short sloping portion is followed by a body portion that ends in the second smaller diameter end. The cord is affixed to the smaller diameter end and is guided onto the spool at the larger diameter end. Such spools are described in CH 581,257; EP 0,554,212; DE 195, 05,824; EP 1,431,508; EP 1,577,483; U.S. Pat. No. 5,908, 062; and WO 2004/048739.

These spools are used in mechanisms where the spool is mounted to rotate with a driven shaft while remaining stationary in axial direction, i.e. the spool is rotatable but does not move in longitudinal direction. The shape of the spool is especially designed to prevent cord windings of the lift cord being wound about the spool from overlapping, while ensuring the axial transport of these windings.

A problem with these known spools when used in the raising and lowering mechanisms is that it has been difficult, in operation, to get identical windings of lift cords on each and every spool.

It has been found that a number of windings will occasionally slip down the slope of the spools. When this will happen is not directly predictable. It has been found that the weight of the blind acting on a cord winding in a first position on the sloped portion of the spool has a relatively small axial force component in a down-hill direction. Additionally a subsequent winding formed on the spool pushes the previous winding out of its first position to move in axial direction to a second position. The resulting total axial force acting on the cord windings may become too big and result in the slippage of a stack of windings. The slippage in turn results in the bottom bar of a blind being pulled or dropped out of its horizontal position. A slanted position of the bottom bar is objectionable from a consumer's point of view. The problem is particularly visible in window coverings with only two cord spools and can only be corrected by completely lowering the bottom bar and thus unwinding the lift cords from their spools.

It is an object of the present invention to overcome or ameliorate at least one of the disadvantages of the prior art. It is also an object of the present invention to provide alternative structures, which are less cumbersome in assembly and operation and which moreover, can be made relatively inexpensively. Alternatively it is an object of the invention to at least provide the public with a useful choice.

To this end the present invention provides a mechanism for extending or retracting for a covering for an architectural opening with respect to an architectural opening the mechanism including a rotatable drive shaft, at least one lift cord, at least one cord spool for winding and unwinding the at least one lift cord, the cord spool being mounted for rotation with the drive shaft while being axially stationary and the cord spool having a first diameter end and a second diameter end and the first diameter being larger than the second diameter and the spool having a first generally conical circumferential spool portion between the first and second end and the first spool portion having a plurality of steps, each step having a tread.

By having steps extending axially from the first diameter end a cord on such a step will no longer be subject to the combined two axial force components as previously described, but only to the axial "pushing" force component that is caused by each new winding being formed. The axial force component of the weight acting on a cord winding resting on a sloped surface is no longer present. By thus reducing the total axial force acting on each winding the problem of the unwanted and unpredictable slippage of one or more windings is solved.

Advantageously the tread of each step is axially long enough to accommodate a single cord winding but not long enough to accommodate two cord windings, such that in use a newly formed winding will be formed on the first step adjacent the first diameter end and in the process of being formed will push a previous formed cord winding toward the smaller diameter end and off the first step.

According to a further advantage the tread of each step is horizontal in axial direction. Also each tread advantageously has the same axial length.

A further advantage of the invention is to have a formula by which the preceding claims wherein the number of steps in the first spool portion is defined as follows $N_{steps}=(L_{slope}*(\cos\alpha))/L_{step}$, and $N_{steps}$ stands for the number of steps;

$L_{slope}$ stands for the slope length of the spool along which the first spool Portion extends;

$\alpha$ stands for the slope angle of the first spool portion relative to horizontal $L_{step}$ stands for the axial length of each step.

Advantageously a second spool portion extends between the first spool portion and the second diameter end.

According to a further advantage the second spool portion is conical at a smaller taper than the first spool portion.

Also advantageously the second spool portion can be generally cylindrical. Further advantageously the second spool portion has a plurality of strips extending axially between the end of the first spool section and the second spool end.

Alternatively for the cylindrical second spool portion advantageously the circumferential surface of the second spool portion is shaped to have at least one elongated strip-like body portion having a shape consistent with a radius that is larger than the actual spool radius such that the circumferential surface of the strips lies somewhat inwardly from the rest of the circumferential surface of the spool. Advantageously the radius of the at least on strip reduces along the axial length of the second spool section such that the radius of the at least one strip is larger adjacent first spool section and smaller adjacent the second spool end.

Figure 2:
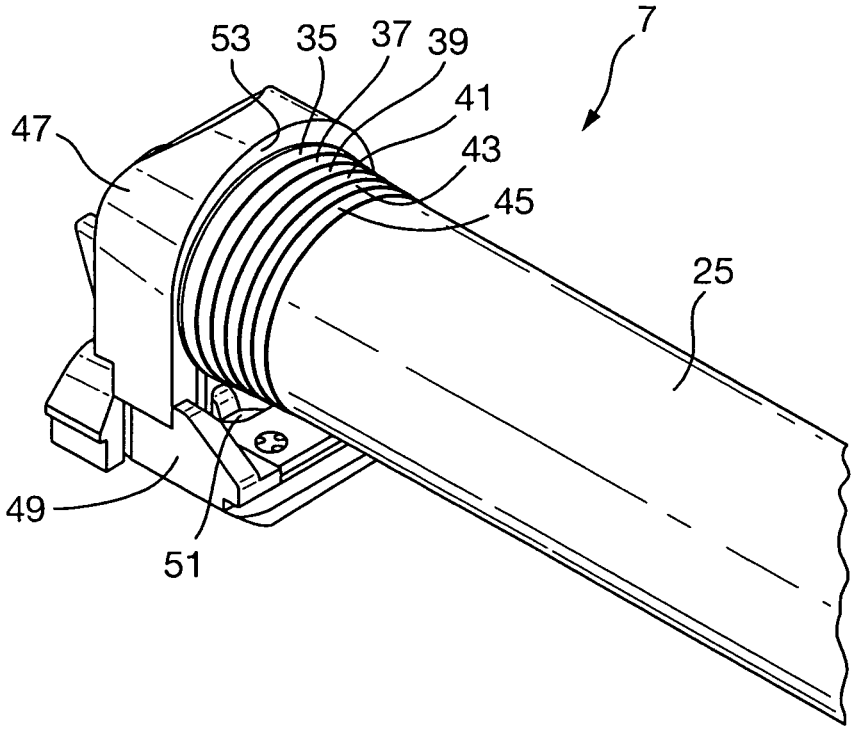
Figure 3:
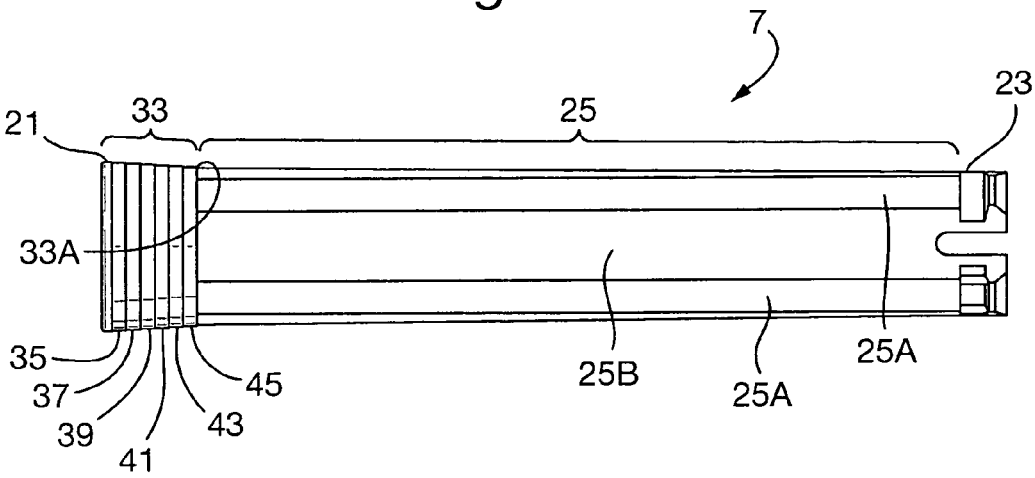
Figure 4:
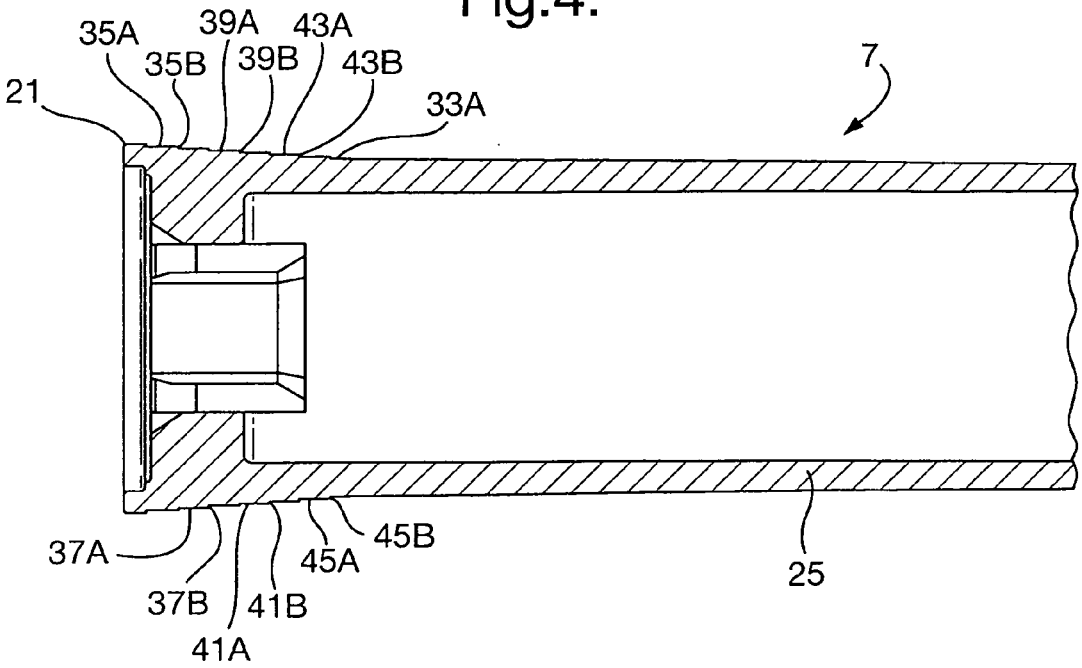

Further aspects of the invention will be apparent from the detailed description below of a particular embodiment and the drawings thereof, in which:

FIG. 1 is a partial cross sectioned drawing of a window covering with the raising and lowering device of to the invention, FIG. 2 is a partial perspective view of the cord spool of the raising and lowering device of the invention in a support member, FIG. 3 is a perspective view of the cord spool of the raising and lowering device of the invention, FIG. 4 is a partial cross sectional view of the cord spool of the raising and lowering device of the invention, FIG. 1 shows a roman shade 1 with a head rail 3 in which on a driven shaft 5 left and a right cord spools 7, 9 are mounted about which a lift cord 11, 13 can be wound and unwound in order to lift or lower the shade. A ball chain operator 15 is shown at one end of the head rail. Either the front or rear length 17A, 17B of the looped ball chain 17 can be pulled whereupon the shaft 5 will be driven to rotate in clockwise or counterclockwise direction. The shaft 5 is rotatable and axially stationary in the head rail. One end 11A, 13A of each lift cord 11, 13 is attached to the bottom bar 19 of the blind, the cord other end 11B, 13B is guided through an opening (not shown) into the head rail and onto the cord spool 7, 9 and is fixed to the respective cord spool 7, 9. Upon rotation of the shaft, the spools are rotated too and the lift cords will be wound on or unwound from the spools, thus lifting or lowering the blind.

The cord spools 7, 9 each have a first or larger diameter end 21, 27, and a second or smaller diameter end 23, 29 as well as a first spool portion 33 (not visible in FIG. 1) and a second spool portion 25, 31 extending axially one behind the other between these diameter ends. The second cord ends are attached to the cord spools at or adjacent the second diameter ends 23, 29 of the cord spools by any suitable means. I.e. by a knot anchored in a slot in the spool or e.g. by clamping the cord end between the spool and a clamp that partially or wholly surrounds the spool.

The cord spools 7, 9 are fixed on the driven shaft 5 and upon rotation of the shaft the spools also rotate. The spools are also fixed with respect to the headrail in respective left and right axial positions by left and right spool support members 47, 47B which are anchored to the head rail such that the support members are aligned with the respective openings in the head rail through which the lift cords 11, 13 are guided onto the spools inside the head rail. Thus the spools are rotatably but do not move in elongated or axial direction. A spool support member 47 (as best visible in FIG. 2) includes a support base 49, a cord opening 51 in its base for the lift cord to pass through and a cord camming surface 53 (not shown) ensuring alignment and transport of all cord windings. The left and right cord spools are identical in shape and further details of the cord spools are illustrated by showing and describing the left cord spool 7 only.

FIGS. 2, 3 and 4 best illustrate the shape of the left cord spool 7. Since all cord spools for a blind are identical only the left cord spool is described in detail. The cord spool 7 has a first or larger diameter end 21 and a second or smaller diameter end 23. Extending from the larger diameter end 21 towards the smaller diameter end is a first sloped or conical portion 33. The sloped portion 33 is chosen to have a relatively steep slope and extends over a relatively short longitudinal portion of the spool 7. The end 33A of the sloped portion 33 has a diameter that is equal or slightly larger than the smaller diameter end 23. Starting from the end 33A of the sloped portion 33 a second or elongated body portion 25 extends to the second diameter end. The second spool body portion is level or very slightly sloped. The second spool portion 25 has two elongated strip-like body portions 25B shaped into having a shape consistent with a radius that is larger than the actual spool radius, thus the circumferential surface of the strips 25B lies somewhat inwardly from the rest of the circumferential surface of the spool and in particular with respect to the adjacent elongated spool sections 25A as shown in FIG. 3. The radius of the strips 25B is sloped along the axial length of the spool. Thus the strip-radius adjacent the first spool section near the last step 45 is larger than the strip radius at the second spool end 23. This facilitates the travel of the cord windings along the second spool portion since it reduces the circumferential surface for the cord winding. The presence of the strips 25B is especially advantageous when the second spool portion is effectively of constant diameter and thus level. The length of the second spool portion 25 is longer than the length of the first spool portion 33. The first spool section 33 is conical with a stronger taper and the second spool portion 25 is level and has effectively a constant diameter. Thus the first spool section 33 has a steeper slope angle then the second spool portion 25. Furthermore, the first spool portion 33 is subdivided in a plurality of steps 35, 37, 39, 41, 43, 45 each having a tread 35A, 37A, 39A, 41A, 43A, 45A and riser 35B, 37B, 39B, 41B, 43B, 45B. The steps are in the circumferential surface of the first spool section and each tread is horizontal and extends in axial direction and each riser is generally vertical and extends in radial direction towards the central axis of rotation of the spool. The horizontal treads of the steps will prevent an axial force component stemming from the weight of the blind from acting on the cord windings. Thus the total axial force acting on the cord windings has been limited. Each tread of each step is wide enough to accommodate one cord winding but too narrow to accommodate two cord windings. Thus depending on the diameter ($D_{cord}$) of the pull cord in use, the length of the step ($L_{step}$) will be chosen to be $1*D_{cord}=<L_{step}<2*D_{cord}$. The length of the spool along which the sloped portion 33 extends is Lslope. The angle of decline of the sloped portion is $\alpha$. These variables together with the chosen length of the tread $L_{step}$ determine the number of steps $N_{steps}$.

Formula 1 will determine the number of steps as follows $$N_{steps}=(L_{slope}*(\cos\alpha))/L_{step} \quad \text{Formula 1}$$

It is of course then also possible to calculate the height of the riser of each step $H_{riser}$ with Formula 2.

$$H_{riser}=(L_{slope}*(\sin\alpha))/N_{step} \quad \text{Formula 2}$$

The rate of progression of the windings in axial direction along the spool can thus be influenced by altering the slope angle a of the sloped portion 33. As shown above changing the angle while keeping the other variables the same will result in a higher riser. A cord winding on the second step will experience reduced friction compared to a winding on the first step, and likewise on each subsequent step further down the friction is less because the diameter of the spool at each step is reduced compared to that of the previous step.

The last step (45) may be chosen to be of different size to function as a transfer portion between the sloped portion 33 and the second spool portion 25.

In use upon pulling one of the front or rear lengths 17A, 17B of the ball chain 17, the operator 25 will drive shaft 5 to rotate. The spools will also rotate and when the direction of rotation is for lifting the blind the lift cords 11, 13 will be wound about the spools 7, 9. After a few initial turns of the spool during which the lift cord is first wound about the spool the windings will start to form in a first position on the first tread 35A of the spool 7. Each subsequent winding will be formed in the same first position, i.e. on the first tread 35A of the first step 35 and in the process will push the previously formed winding axially away, off the first tread and into a second position on the tread 37A of the second step 37. In moving from the first to the second position this previously formed cord winding pushes the winding that was on the second tread 37A to the third tread 39A. This means that each subsequent winding formed as the cord is wound about the spool pushes each previous winding to the next lower tread of the next step, while the horizontal treads of the steps prevent the cord windings from slipping down the slope. Once windings are also present on the second spool portion, these windings will also be pushed axially, i.e. towards the second spool end. As the windings form on the spool the tension in the cord windings that is present as a result of the weight of the blind acting on the lift cord is gradually reduced to zero. After a certain number of windings are present on the spool the windings closest to the second diameter end will experience zero tension in the winding and the only resistance these windings experience to axial movement is frictional since the weight of the blind no longer directly acts on these windings.

It is thus believed that the operation and construction of the present invention will be apparent from the foregoing description. The invention is further limited by the terms of the claims and not limited to the embodiment herein described, as such it will be clear that the device is not limited to use in a Roman shade. When used in a venetian blind the support member for the cord spool will be differently shaped and the camming member will be differently placed. The slope angle, then number of steps, the length of the sloped section of the spool can all be altered to suit the blind in which the device is used. Alternatively the whole spool body can be conical and formed in steps each having a tread and a riser. Although in the example only two cord spools are present in the window covering, in larger window coverings more spools can be used. Ideally for each lift cord a spool is provided.

Other means for driving the shaft 5 then the ball chain operator 15 can be provided, e.g. a motor, a spring motor, a crank shaft, a single pull cord drive system etc.

In an alternative embodiment the second spool portion may be conical like the first spool portion but with a smaller taper.

Directional and positional expressions, such as upper, lower, top, bottom, left, right, above, below, vertical, horizontal, clockwise, counter clockwise or like are generally used only to assist in understanding of the present invention as illustrated in the accompanying drawing figures. None of this should be construed to create limitations, as to position, orientation in actual use of the invention.

The invention claimed is:

1. A mechanism for extending or retracting for a covering for an architectural opening with respect to the architectural opening, comprising:

a rotatable drive shaft that remains axially stationary;

at least one lift cord; and at least one cord spool for winding and unwinding the at least one lift cord, wherein the at least one cord spool is mounted on the rotatable drive shaft for rotation with the rotatable drive shaft, and is fixed in an axial position on the rotatable drive shaft so that the at least one cord spool is axially stationary and is not moveable in an axial direction, wherein the at least one cord spool has a first diameter end and a second diameter end, the first diameter being larger than the second diameter and the at least one cord spool having a first generally conical circumferential spool portion therebetween, wherein the first generally conical circumferential spool portion comprises a number of steps each step having a tread, wherein the number of steps in the first spool portion is defined as, $$N_{steps}=(L_{slope}*(\cos\alpha))/L_{step}$$

in which formula $N_{steps}$ stands for the number of steps;

$L_{slope}$ stands for the length of the spool along which the first spool portion extends;

$\alpha$ stands for the slope angle of the first spool portion relative to horizontal; and $L_{step}$ stands for the axial length of each step.

2. The mechanism of claim 1 wherein a tread of each step is axially long enough to accommodate a single cord winding but not long enough to accommodate two cord windings, such that in use a newly formed winding will be formed on the first step adjacent the first diameter end and in the process of being formed will push a previous formed cord winding toward the smaller diameter end and off the first step.

3. The mechanism of claim 1 wherein a tread of each step is horizontal in axial direction.

4. The mechanism of claim 2 wherein each tread has the same axial length.

5. The mechanisms of claim 1 wherein a second spool portion is between the first spool portion and the second diameter end.

6. The mechanism of claim 5 wherein the second spool portion is conical at a smaller taper than the first spool portion.

7. The mechanism of claim 5 wherein the second spool portion is generally cylindrical.

8. The mechanism of claim 5 wherein the second spool portion comprises a plurality of steps extending axially between the end of the first spool section and the second spool end.

9. The mechanism of claim 7 wherein a circumferential surface of the second spool portion is shaped to have at least one elongated strip extending axially between the end of the first spool portion and the second spool end and having a shape consistent with a radius that is larger than the actual spool radius.

10. The mechanism of claim 9 wherein the radius of the at least one elongated strip reduces along the axial length of the second spool section, such that the radius of the at least one elongated strip is larger adjacent first spool section and smaller adjacent the second spool end.

* * * * *